US005323886A

United States Patent [19]

Chen

[11] Patent Number: 5,323,886

[45] Date of Patent: Jun. 28, 1994

[54] SUITCASE

[76] Inventor: Shou-Mao Chen, No. 7-3, Lane 2, Ta An Kang Rd., Ta Chia Chen,, Taichung Hsien, Taiwan

[21] Appl. No.: 51,218

[22] Filed: Apr. 23, 1993

[51] Int. Cl.[5] ..... A45C 13/28

[52] U.S. Cl. ..... 190/18 A; 16/115; 190/24; 280/47.18; 280/655

[58] Field of Search ..... 190/18 A, 111, 18 R, 190/24, 29, 34, 39; 16/30, 40, 115; 280/37, 40, 654, 655, 47.18

[56] References Cited

U.S. PATENT DOCUMENTS

| | | | |
|---|---|---|---|
| 1,709,972 | 4/1929 | Dibsdale | 16/30 |
| 4,036,336 | 7/1977 | Burtley | 190/18 A |
| 4,340,132 | 7/1982 | Cerna | 190/18 A |
| 4,471,508 | 9/1984 | Seaborg | 16/18 R |
| 4,618,035 | 10/1986 | Mao | 190/18 A |
| 4,743,038 | 5/1988 | Myers et al. | 190/18 A X |
| 4,761,012 | 8/1988 | Dames | 190/18 A X |
| 4,995,487 | 2/1991 | Plath | 190/111 X |
| 5,024,455 | 6/1991 | Schrecongost | 190/18 A X |

*Primary Examiner*—Allan N. Shoap
*Assistant Examiner*—Christopher McDonald
*Attorney, Agent, or Firm*—Morton J. Rosenberg; David I. Klein

[57] ABSTRACT

A suitcase made in a rectangular configuration having a retractable handle assembly detachably fastened to one long side thereof, the retractable handle assembly having wheel holders fixed thereto at the bottom to hold two wheels by bolts and lock screws, a hollow base frame fastened to one short side thereof to hold a retractable bracket, and a tie strap having a middle part detachably fastened to an opposite short side of the suitcase and two hooks on two opposite ends thereof hooked on the retractable bracket to hold a case, etc., outside the suitcase.

2 Claims, 9 Drawing Sheets

SUITCASE

BACKGROUND OF THE INVENTION

The present invention relates to suitcases, and more specifically the present invention relates to a suitcase which has a retractable handle, a retractable bracket, and a tie strap that are collapsible and replaceable.

Various suitcases are manufactured, and widely used for carrying clothes, etc. These suitcases may be attached with additional fittings and accessories, for example: bracket, hand-carrying handle, retractable handle, tie strap, etc., for different purposes. However, these additional fittings and accessories are not detachable once they are made.

SUMMARY OF THE INVENTION

The present invention provides a suitcase in a rectangular configuration having a retractable handle assembly detachably fastened to one long side thereof, a hollow base frame fastened to one short side thereof to hold a retractable bracket, and a tie strap having a middle part detachably fastened to an opposite short side of the suitcase and two hooks on two opposite ends thereof hooked on the retractable bracket to hold a case, etc., outside the suitcase, wherein the retractable handle assembly has wheel holders fixed thereto at the bottom to hold two wheels by bolts and lock screws.

DETAILED DESCRIPTION OF THE PREFERRED EMBODIMENT

Figure 1:
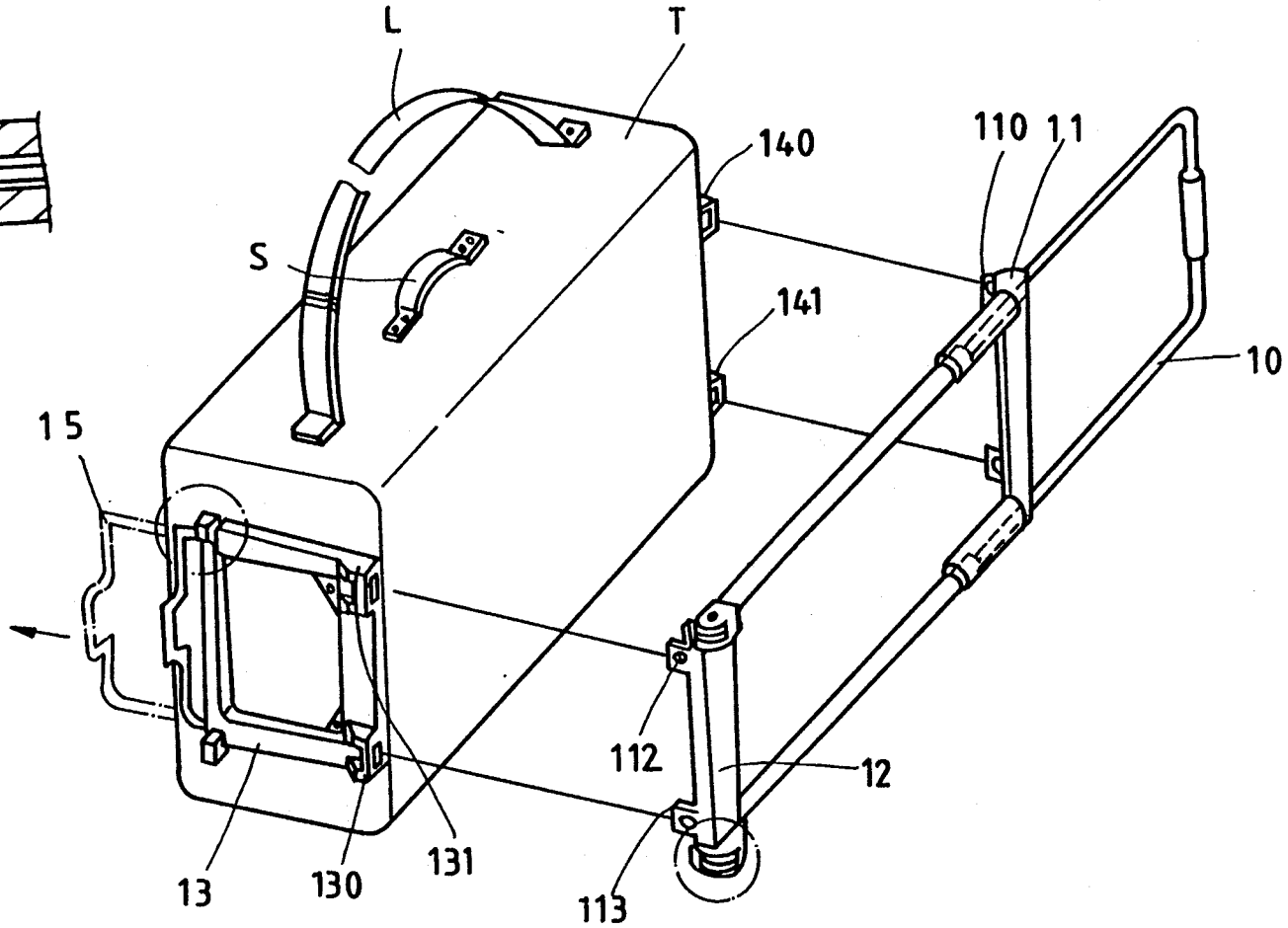
FIG. 1 is a perspective view of a suitcase constructed according to the preferred embodiment of the present invention, showing the retractable handle dismantled.
Figure 1B:
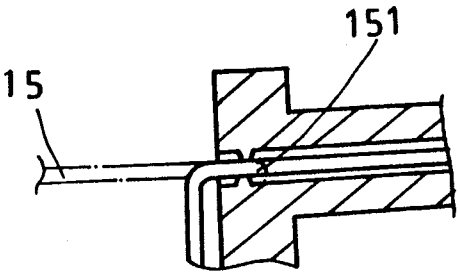
FIG. 1B is a cross-sectional view partially cut away showing a retractable bracket insertable within a base frame of the suitcase.
Figure 2A:
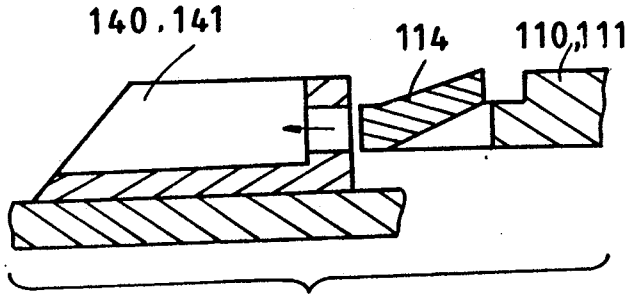
FIG. 2A is a schematic sectional view showing one plug member on the upper connecting frame prior to being fastened to a respective socket member on the suitcase.
Figure 2B:
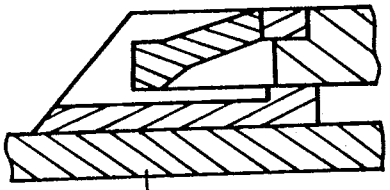
FIG. 2B is a schematic sectional view showing a plug member on the upper connecting frame fastened to a respective socket member on the suitcase.
Figure 2C:
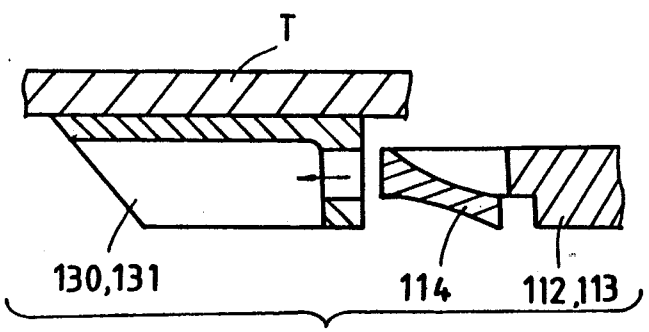
FIG. 2C is a schematic sectional view showing one plug member on the lower connecting frame prior to being fastened to a respective socket member on the suitcase.
Figure 2D:
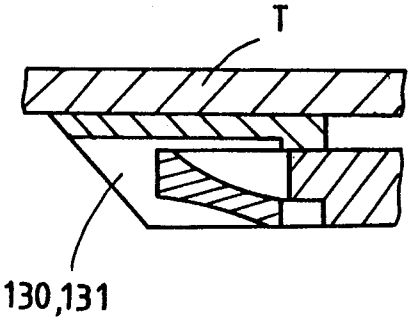
FIG. 2D is a schematic sectional view showing a plug member on the lower connecting frame fastened to a respective socket member on the suitcase.
Figure 2:
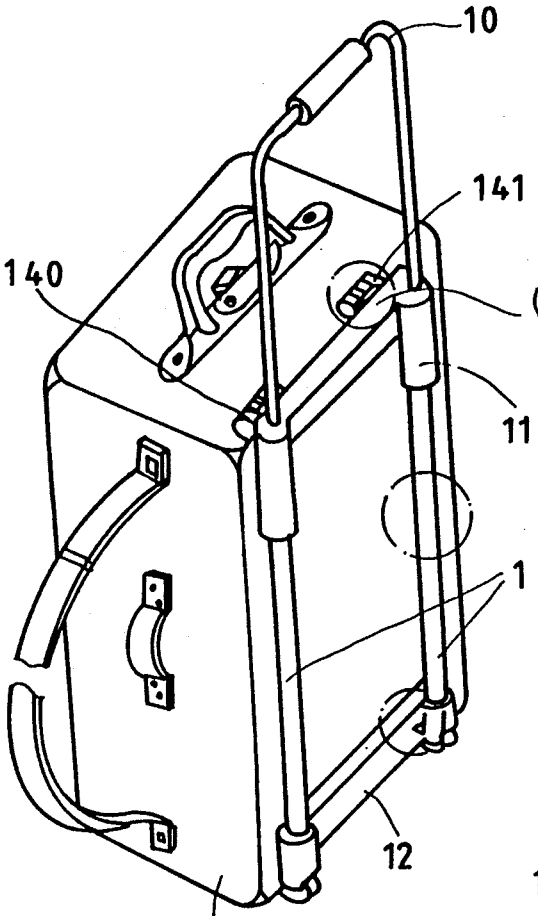
FIG. 2 is a perspective assembly view of the suitcase.

Referring to FIGS. 1 and 2, a suitcase T is made in a flat, rectangular configuration having four long sides and two short sides. The suitcase T can be carried with the hand horizontally as well as vertically. A handle S and an adjustable strap L are respectively fixed to one of the long sides of the suitcase T. A base frame 13 is fixed to one short side of the suitcase T. There is provided a retractable bracket 15 having two opposite ends respectively and slidably retained in respective holes on the base frame 13. Therefore, the retractable bracket 15 can be moved out of the base frame 13 and then set back into position. Two socket members 130;131 are spaced on the base frame 13 at an opposite side. Two socket members 140;141 are spaced on the other short side of the suitcase T opposing to the socket members 130;131 on the base frame 13. Two sleeves 1 are joined in parallel by an upper connecting frame 11 and a lower connecting frame 12 to hold a retractable handle 10. Plug members 110;111;112;113 are respectively made on the connecting frames 11;12 at locations corresponding to the socket members 140;141;131 130 for connection.

Referring to FIGS. 2A and 2B, each plug member 110;111;112;113 has a spring bolt 114 obliquely upwardly extending backwards, which can be squeezed from a bevel position into a horizontal position to enter the respective socket member 140;141;131;130. Once the spring bolt 114 is inserted into the respective socket member, it immediately returns to its former position to lock up with the socket member.

Figures 1A, 1C:
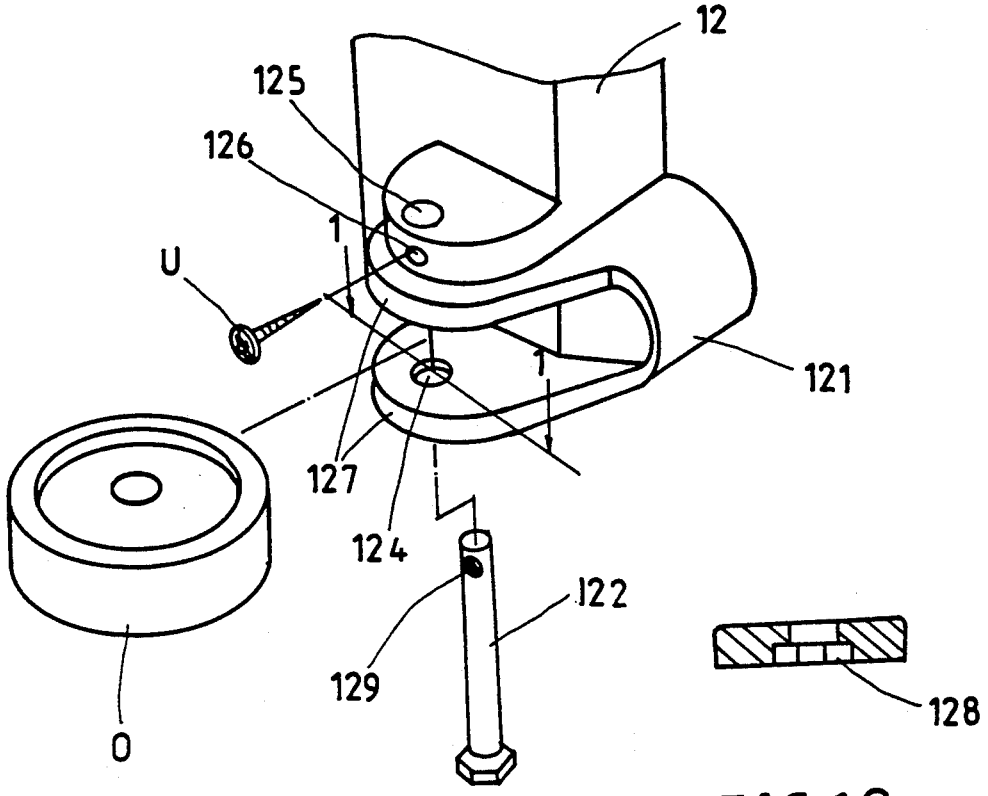
FIG. 1A is an exploded view of a wheel holder and a wheel on either end of the lower connecting frame of the retractable handle.
FIG. 1C is a sectional view of a side wall of a wheel holder taken along the section line 1—1 of FIG. 1A.

Referring to FIG. 1A and FIG. 1 again, two wheel holders 121 are respectively fastened to the lower connecting frame 12 on two opposite ends thereof to hold a respective wheel 0 by a respective hexagonal head bolt 122. The wheel holder 121 has axle holes 124;125 through two opposite side walls 127 thereof, into which a respective hexagonal head bolt 122 is inserted to hold a respective wheel 0 in between the two opposite side walls 127 of the wheel holder 121, and a lock hole 126 on one side wall 127 perpendicularly extended to the corresponding axle hole 125 through which a lock screw U is threaded into a screw hole 129 on the hexagonal head bold 122. The other side wall 127 of the wheel holder 121 has a hexagonal countersunk hole 128 aligned with the corresponding axle hole 124 which receives the hexagonal head of the hexagonal head bolt 122.

Figure 3:
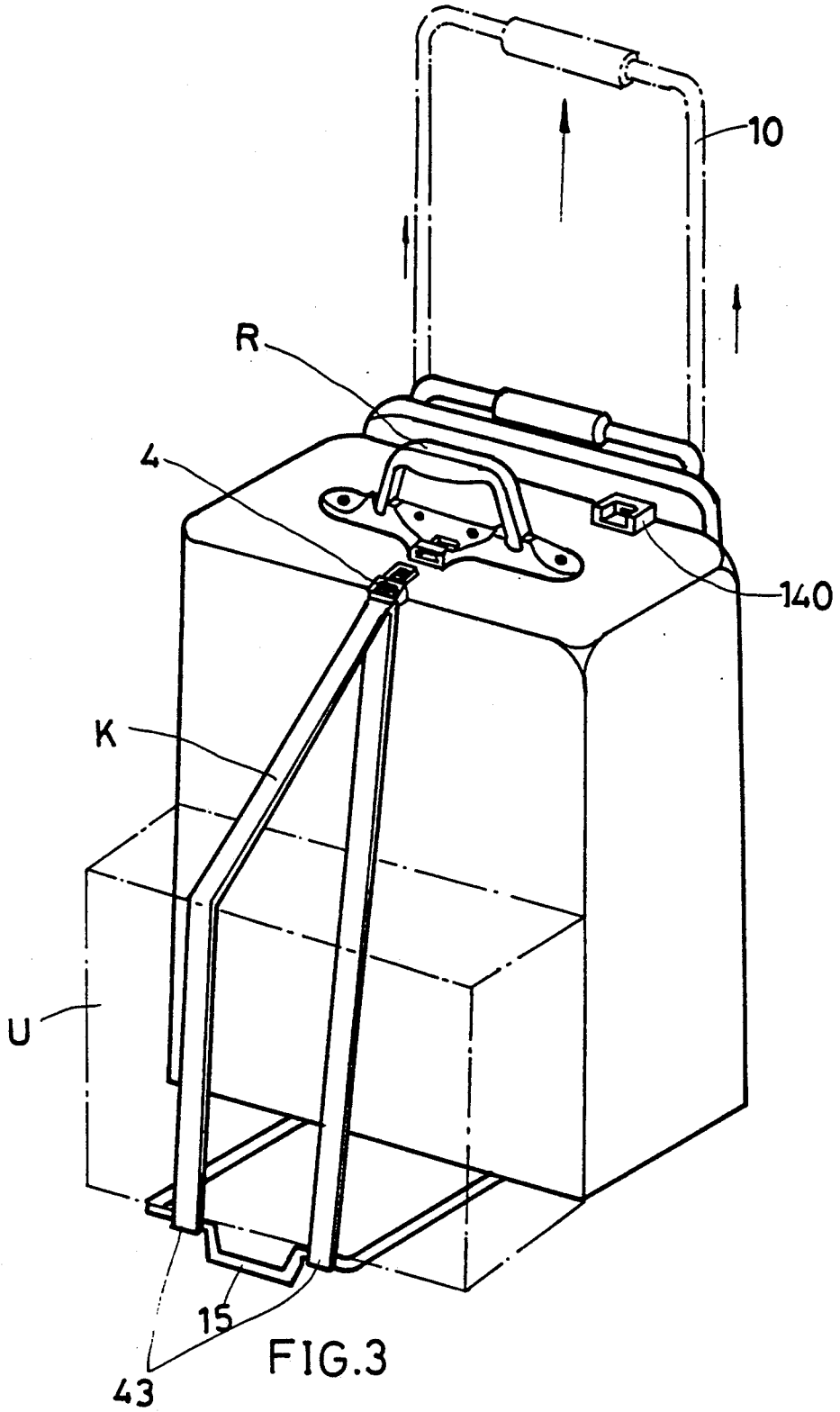
FIG. 3 is a perspective view showing a tie strap fastened to a socket member on a handle mount on the suitcase by a plug member to hold down a case on the retractable bracket outside the suitcase.
Figure 3A:
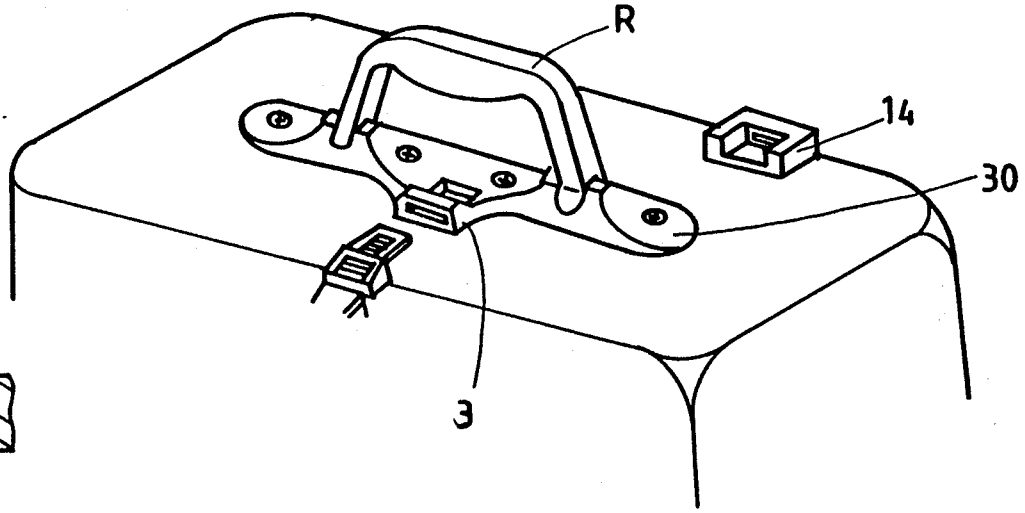
FIG. 3A is a perspective view partially cut away showing the top portion of the suitcase.
Figure 3C:
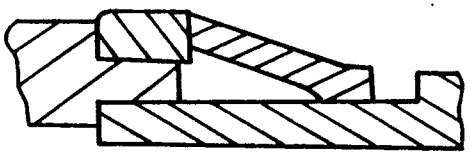
FIG. 3C is a schematic sectional drawing showing the connection between the socket member on the handle mount and the plug member on the tie strap.
Figure 3B:
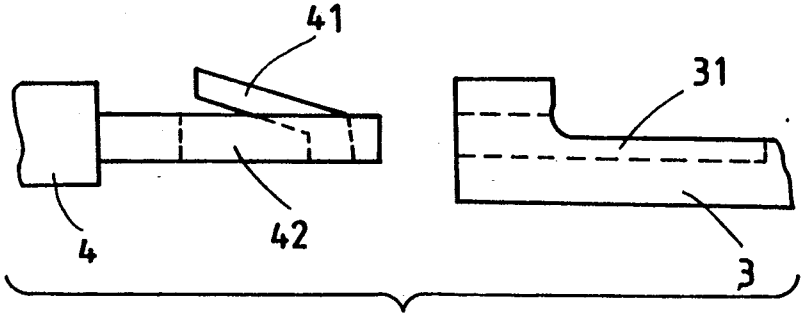
FIG. 3B is a schematic drawing showing the socket member on the handle mount and the plug member on the tie strap.

Referring to FIGS. 3 and 3A, a handle mount 30 is fastened to one short side of the suitcase opposite to the retractable bracket 15 to hold a handle R. A socket member 3 is fixed to the handle mount 30 in the middle to which a plug member 4 is fastened to hold a tie strap K. The plug member 4 has a spring bolt 41 in an open frame 42 thereof. The spring bolt 41 can be squeezed from a bevel position into a horizontal position to enter a retaining hole 31 on the socket member 3. As the spring bolt 41 is inserted into the retaining hole 31, it immediately returns to its former position to lock up with the socket member 3. The tie strap K is inserted through a loop (not shown) on the plug member 4, having two hooks 43 on two opposite ends thereof respectively hooked on the retractable bracket 15 to tie up an external case U.

Figure 4:
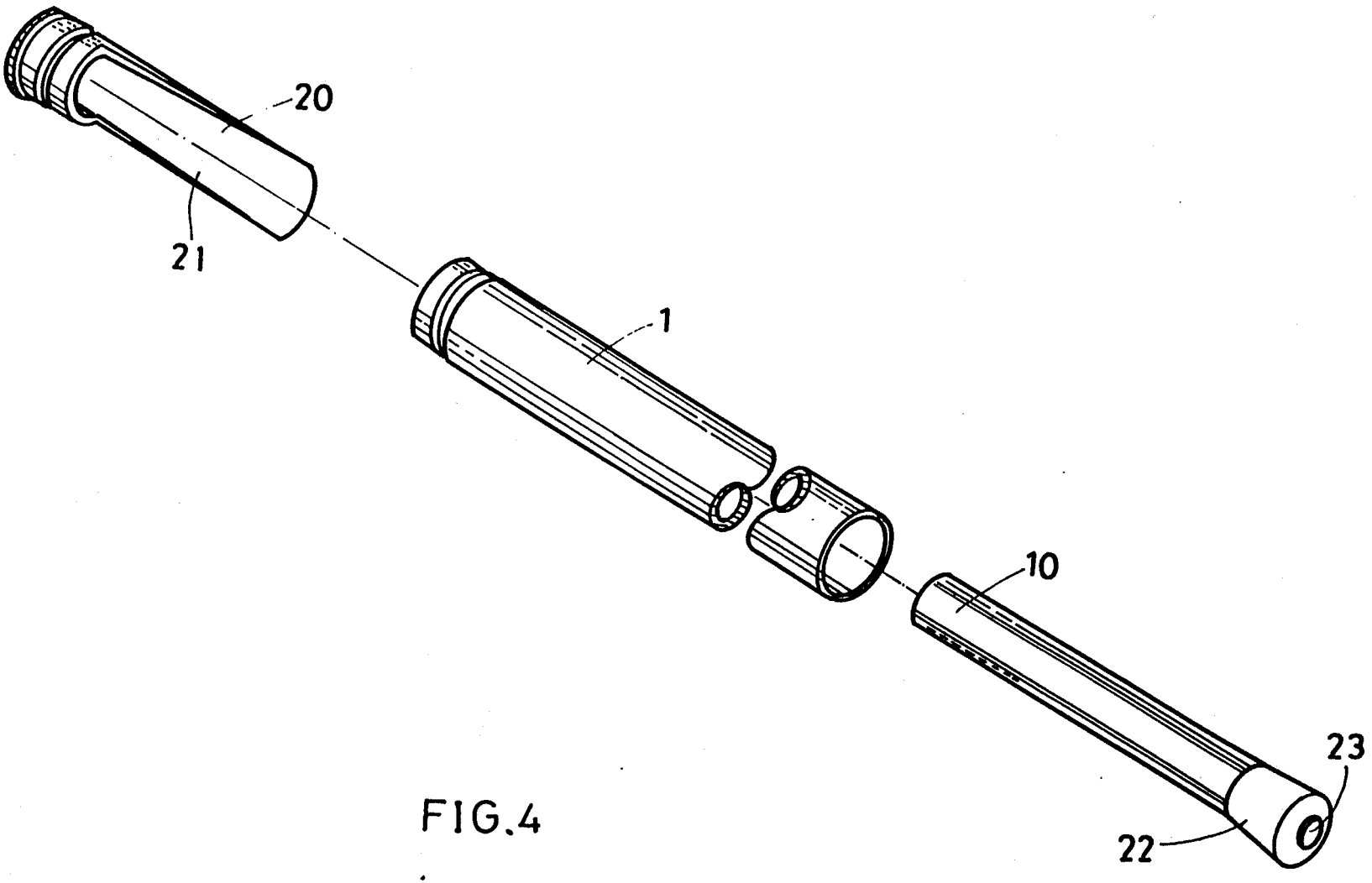
FIG. 4 is a partial perspective exploded view of the retractable handle, the respective terminal bushing, and the respective sleeve.
Figure 4A:
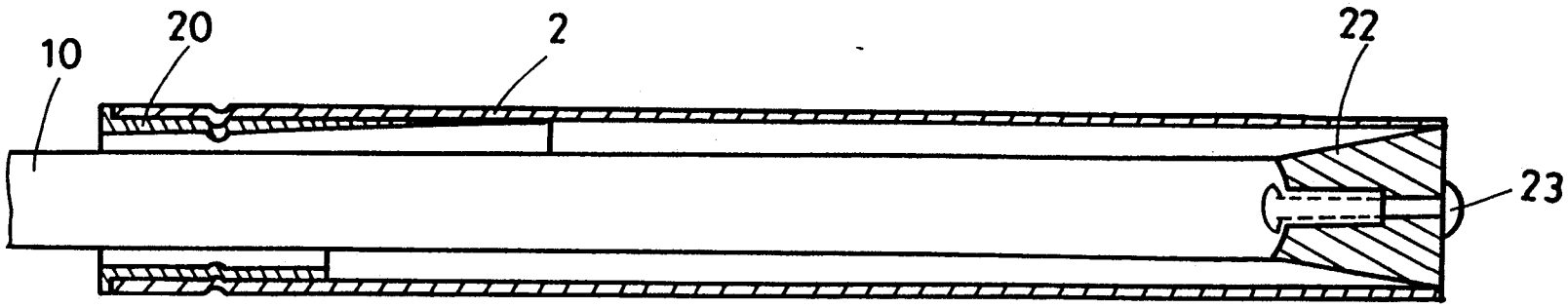
FIG. 4A is a plan view showing one end of the retractable handle inserted into the respective terminal bushing inside the respective sleeve.
Figure 4B:
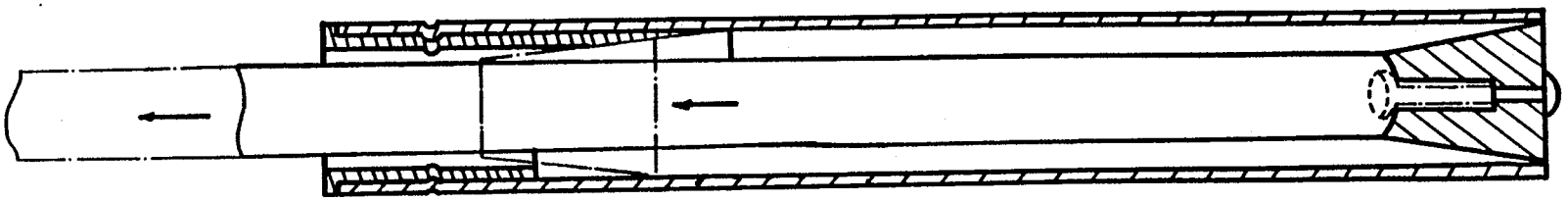
FIG. 4B is similar to FIG. 4 but showing the retractable handle slided in the respective sleeve.

Referring to FIGS. 4, 4A and 4B, the retractable handle 10 has two opposite ends respectively inserted into a respective rigid terminal bushing 20 in either sleeve 1 and then fastened with a respective rigid end truncated cone 22 by a screw 23. The terminal bushing 20 fits into either sleeve 1 at the top (near the upper connecting frame 11), having a bottom end obliquely cut away in the axial direction and formed into a friction channel 21. As the retractable handle 10 is pulled out of the sleeves 1, the rigid end truncated cone 22 on either end of the retractable handle 10 becomes firmly engaged with the friction channel 21 to stop the retractable handle 10 in position, and therefore the retractable handle 10 does not disconnect from the sleeves 1.

Figure 5:
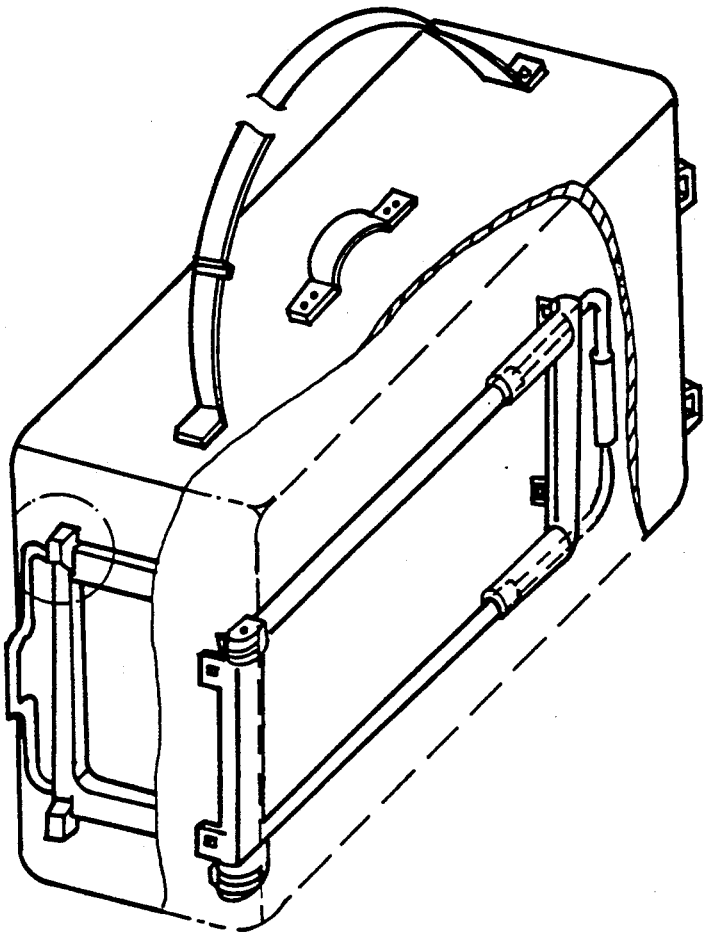
FIG. 5 is a perspective view of the suitcase showing the retractable handle received inside the suitcase.

Referring to FIG. 5, the suitcase T may be carried with the hand by the retractable handle 10. The whole assembly of the retractable handle 10 including the sleeves 1, the upper and lower connecting frames 11;12, and the plug members 110;111;112;113, may be detached from the suitcase T and then received inside the suitcase T. Using the handle S or strap L, the suitcase T is carried with the hand conveniently.

I claim:

1. A rectangular suitcase comprising a retractable handle assembly fastened to one long side thereof, a base frame fastened to one short side thereof, a retractable bracket reversibly insertable within said base frame for mounting articles thereon external said suitcase, a wheel assembly fastened to said retractable handle assembly at one end adjacent to said base frame, and a tie strap assembly fastened to an opposite short side thereof, said tie strap assembly including a looped plug member detachably fastened to a socket member on another short side of said suitcase opposite said base frame, a tie strap member insertable through a loop member formed on said looped plug member for securing articles to said retractable bracket, said tie strap member having a pair of hooks respectively mounted on opposing ends thereof for hooking onto said retractable bracket, wherein said retractable handle assembly comprises two parallel sleeves joined by an upper connecting frame and a lower connecting frame, and a retractable handle having two opposite ends respectively and slidably inserted through a respective terminal bushing inside either sleeve, said upper and lower connecting frames having each two plug members at two opposite ends respectively and detachably fastened to two socket members on either short side of said suitcase.

2. The suitcase of claim 1 wherein said wheel assembly comprises two wheel holders respectively fixed to said lower connecting frame at two opposite ends to hold two wheels respectively, each wheel holder comprising an axle hole through two opposite side walls thereof, a hexagonal head bolt inserted through said axle hole to hold either wheel in between said two opposite side walls, and a lock screw threaded through a bottom hole on one side wall of the respective wheel holder at the bottom into a screw hole on the respective hexagonal head bolt to lock it in place.

* * * * *